US005979060A

United States Patent [19]

Holzbauer et al.

[11] Patent Number: 5,979,060

[45] **Date of Patent: *Nov. 9, 1999**

[54] HAIR CUTTING SYSTEM HAVING A COMB ADJUSTMENT BUTTON AND A POWDER BUTTON

[75] Inventors: Jürgen Holzbauer, Klagenfurt, Austria; Tah Ching Yang, Groningen, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/984,825

[22] Filed: Dec. 4, 1997

[30] Foreign Application Priority Data

Dec. 13, 1996 [EP] European Pat. Off. ..... 96890191

[51] Int. Cl.[6] ..... B26B 19/38

[52] U.S. Cl. ..... 30/201; 30/200

[58] Field of Search ..... 30/43.92, 200, 30/201, 202, 341, 517, 518; D8/1, 10, 312, 313, DIG. 7; 310/47, 50, 89

[56] References Cited

U.S. PATENT DOCUMENTS

| | | | |
|---|---|---|---|
| D. 375,035 | 10/1996 | Mangol | D8/DIG. 7 |
| 726,795 | 4/1903 | Cornu | 310/50 |
| 1,507,716 | 9/1924 | Redman | 310/47 |
| 1,899,102 | 2/1933 | Michael | 30/202 |
| 1,928,000 | 9/1933 | Adelmo | 30/202 |
| 1,982,979 | 12/1934 | Buller | 30/202 |
| 2,013,279 | 9/1935 | Maleev | 30/202 |
| 2,294,713 | 9/1942 | Boerger | 310/50 |
| 2,480,920 | 9/1949 | Gullong | 30/202 |
| 2,650,993 | 9/1953 | Brown et al. | 310/50 |
| 3,287,805 | 11/1966 | De Charme | 30/202 |
| 3,334,416 | 8/1967 | Green | 30/200 |
| 3,805,136 | 4/1974 | Meyer et al. | 310/50 |
| 4,085,503 | 4/1978 | Beck et al. | 30/201 |
| 4,557,050 | 12/1985 | Haraguchi et al. | 30/201 |
| 4,581,822 | 4/1986 | Fujimura | 30/201 |
| 4,667,189 | 5/1987 | Ullman | 30/196 |
| 5,050,305 | 9/1991 | Baker et al. | 30/201 |
| 5,325,589 | 7/1994 | Kubo | 30/201 |
| 5,459,927 | 10/1995 | Kauer et al. | 30/43.1 |

FOREIGN PATENT DOCUMENTS

| | | | |
|---|---|---|---|
| 648078 | 8/1937 | Germany | 30/196 |
| 61-79483 | 4/1986 | Japan . | |

OTHER PUBLICATIONS

Philips "Designation HS 025" (2 pages).
European Search Report PCT/IB97/01366 dated Feb. 1998.

*Primary Examiner*—Douglas D. Watts
*Assistant Examiner*—Gyounghyun Bae
*Attorney, Agent, or Firm*—Ernestine C. Bartlett

[57] ABSTRACT

In a hair-cutting system (1) including a hair-cutting apparatus (2) comprising a toothed cutting device (14) having a toothed cutter (15) which is drivable by a motor (17), and a comb device (19) which can be coupled to the toothed cutting device (2) and which comprises an adjustable comb section (22), the hair-cutting apparatus (2) has an adjustment button (48) for adjusting the adjustable comb section (22) of the comb device (19) and an on/off button (74) for switching on and switching off the motor (17), the adjustment button (48) being arranged at the location of a front side (10) of the hair-cutting apparatus (2) and the on/off button (74) being arranged at the location of a back side (11) of the hair-cutting apparatus (2).

3 Claims, 4 Drawing Sheets

HAIR CUTTING SYSTEM HAVING A COMB ADJUSTMENT BUTTON AND A POWDER BUTTON

FIELD OF THE INVENTION

Hair-cutting system including a hair-cutting apparatus having an adjustment button and an on/off button.

The invention relates to a hair-cutting system comprising a hair-cutting apparatus for cutting hairs, which apparatus has an elongate housing comprising a grip part to be held in a hand during operation and a coupling part which is offset from the grip part and which has a distal coupling-part end remote from the grip part, and comprising at the location of the distal coupling-part end a toothed cutting device having two toothed cutters, of which both toothed cutters are disposed at the location of a front side of the hair-cutting apparatus and of which one toothed cutter is reciprocatingly drivable by a motor accommodated in the hair-cutting apparatus. The hair-cutting apparatus also comprises an on/off button, which is arranged in the grip part of the housing and which is movable between an on-position and an off-position to turn on and turn off the motor, and a comb device which can be coupled to the hair-cutting apparatus in the coupling part of the housing, the location of the toothed cutting device thereof in a mounting direction and which can be removed from the hair-cutting apparatus in a direction opposite to the mounting direction, at least one comb section of said comb device being adjustable to a plurality of settings with respect to the toothed cutting device in order to obtain different hair-cutting lengths. The hair-cutting apparatus further comprises an adjustment button, for adjusting at least the comb section with respect to the toothed cutting device, which adjustment button is disposed in the area of the front side of the hair-cutting apparatus, adjacent the coupling part, and can be set to a plurality of settings, which adjustment button can be actuated by the thumb of the hand holding the grip part during operation due to its arrangement in the area of the front side of the hair-cutting apparatus, adjacent the coupling part.

BACKGROUND OF THE INVENTION

A hair-cutting system of the type defined in the opening paragraph is commercially available from the Applicant under the type designation HS 025 and is known therefrom. In the known hair-cutting system the hair-cutting apparatus comprises an adjustment button formed by a slide button and an on/off button also formed by a slide button. Both buttons are arranged in line with one another in the longitudinal direction of the housing at the location of the front side of the hair-cutting apparatus in the grip area of the housing, the adjustment button being disposed adjacent the coupling area, i.e. nearer the toothed cutting device of the hair-cutting apparatus and the on/off button being disposed behind it in the longitudinal direction of the housing, i.e. further away from the toothed cutting device. In the known hair-cutting system the adjustment button is simply and easily slidable between several, i.e. seven settings in total, by the thumb of the hand which holds the grip area of the hair-cutting apparatus during operation. In order to actuate the on/off button of the known hair-cutting system the thumb of the hand which holds the grip area of the hair-cutting apparatus during operation should be placed on the on/off button, after which the on/off button can be slid between its on-position and its off-position. After the on/off button has been slid, for example, into its on-position in order to switch on the motor of the hair-cutting apparatus, upon which the toothed cutting device of the hair-cutting apparatus is put into operation, the thumb should be moved to the adjustment button in order to enable a desired hair-cutting length to be adjusted, for which it is not only necessary to move the thumb but also to change the position of the entire hair-cutting apparatus in the hand holding the hair-cutting apparatus. This is a comparatively inconvenient operation, which is consequently susceptible of improvement.

SUMMARY OF THE INVENTION

It is an object of the invention to preclude the aforementioned problems and to provide an improved hair-cutting system of the type defined in the opening paragraph, in which a simple and easy handling is guaranteed in a simple manner and substantially without any additional means. According to the invention, in order to achieve this object in a hair-cutting system of the type defined in the opening paragraph, the on/off button is arranged in the area of a back side of the hair-cutting apparatus, adjacent the coupling part, which back side is situated opposite the front side of the hair-cutting apparatus, and the on/off button is disposed substantially opposite the adjustment button. Because of this arrangement, the on/off button can be actuated by at least one finger of the hand in which the grip part is held during operation. Additionally, due to these measures in accordance with the invention, it is achieved in a simple manner and substantially without any additional means that the adjustment button is simply and easily movable between its various settings with the thumb of the hand in which the hair-cutting apparatus is held during operation and, moreover, that the on/off button can be actuated simply and easily with another finger of the hand in which the hair-cutting apparatus is held during operation, in such a manner that for the actuation of the adjustment button or the on/off button it is not necessary to change the hold on the hair-cutting apparatus during operation. This is because the two buttons, i.e. both the adjustment button and the on/off button, are constantly in contact with those fingers of the hand holding the hair-cutting apparatus during operation, which are envisaged for the actuation of these buttons. Thus, both switching functions can be performed by means of the hand holding the hair-cutting apparatus during operation, without a relative movement between this hand and the housing of the hair-cutting apparatus being required, so that the hair-cutting apparatus always remains in the same relative position with respect to the hand holding the hair-cutting apparatus, both during the actuation of switching functions and during hair-cutting.

It is to be noted that a hair-cutting system of the type defined in the opening paragraph has been put on the market, having in the grip area of the housing of its hair-cutting apparatus an adjustment button which is movable between a plurality of settings and an on/off button which is movable between an on-position and an off-position. However, in this known apparatus the on-off button is disposed at the location of the front of the hair-cutting apparatus and the adjustment button is disposed at the location of the back of the hair-cutting apparatus, as a result of which the on/off button, which is movable between only two switching positions, is situated at the location of the thumb of the hand holding the hair-cutting apparatus during operation and the adjustment button, which is movable between a plurality of settings, is disposed at the location of the further finger of the hand holding the hair-cutting apparatus during operation. This construction has the distinct inconvenience that the adjustment button, which is movable between a plurality of settings, must be actuated with the other fingers of the hand holding the hair-cutting apparatus, which has proved to be inconvenient and unfavorable. Conversely, in a hair-cutting system in accordance with the invention the adjustment button, which is movable between a plurality of settings, is disposed at the location of the front side of the hair-cutting apparatus and the on/off button, which is movable between only two switching positions, is disposed at the location of the back of the hair-cutting apparatus, which has the afore-mentioned advantage that the adjustment button is easily movable between the plurality of settings by the thumb of the hand holding the hair-cutting apparatus during operation and that the on/off button can also be actuated simply and conveniently by a further finger of the hand in which the hair-cutting apparatus is held during operation.

In a hair-cutting system in accordance with the invention the on/off button can be formed, for example, by a push-button. However, in conjunction with a hair-cutting system it has proved to be advantageous if the on/off button is formed by a slide button, which can be actuated by two adjacent fingers of the hand in which the grip part is held during operation. This construction has proved to be advantageous for an optimum ease of operation.

For a convenient operation of the hair-cutting system it has also proved to be very advantageous if the coupling part of the housing of the hair-cutting apparatus is inclined relative to the grip part, and the coupling part and the grip part adjoin one another in a convex housing part at the front and in a concave housing part at the back, and the on/off button is arranged directly adjacent the concave housing part. Such a construction has proved to be particularly simple and convenient to use in practical tests.

The afore-mentioned as well as further aspects of the invention will be apparent from the embodiment described hereinafter by way of example and will be elucidated on the basis of this embodiment.

BRIEF DESCRIPTION OF THE DRAWINGS

The invention will now be described in more detail with reference to the drawings, which show an embodiment given by way of example but to which the invention is not limited.

DETAILED DESCRIPTION OF THE PREFERRED EMBODIMENTS

Figure 1:
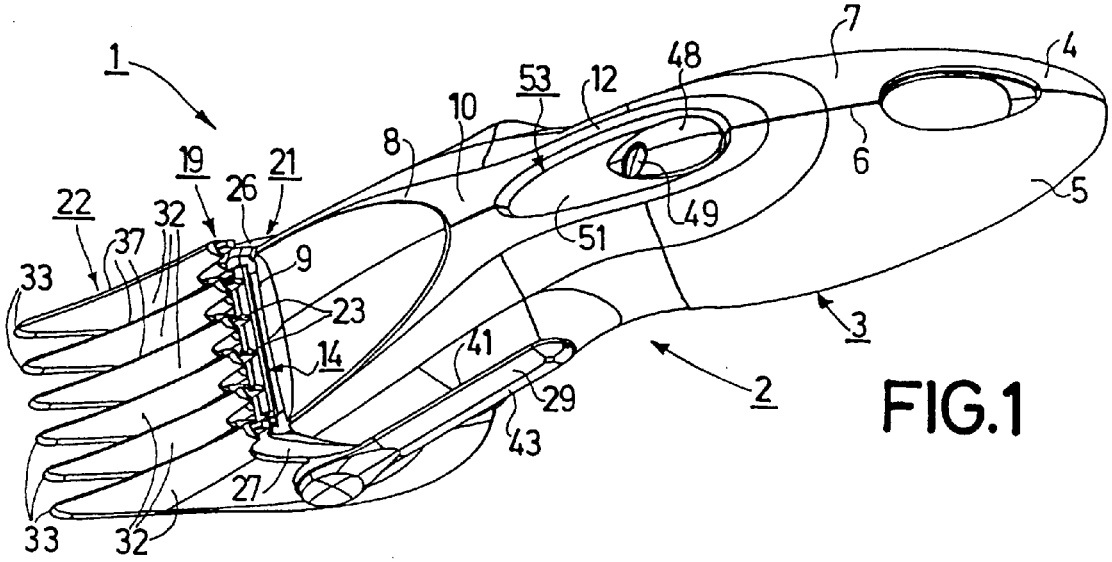
FIG. 1 is a slightly scaled-down oblique view from above, showing a hair-cutting system in accordance with an embodiment of the invention, which system comprises a hair-cutting apparatus and a comb device mounted on the hair-cutting apparatus and comprising a comb section which is stationarily mounted relative to the hair-cutting apparatus and an adjustable comb section, the hair-cutting apparatus having an adjustment button in the area of its front, for adjusting the adjustable comb section, and an on/off button in the area of its back and not shown in FIG. 1, for switching on and switching off a motor of the hair-cutting apparatus.
Figure 2:
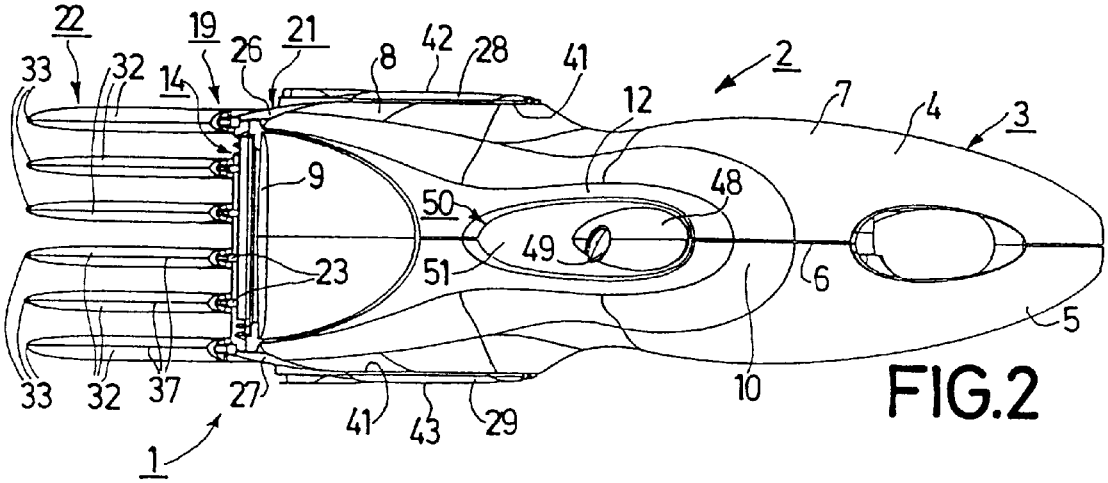
FIG. 2 is a plan view of the hair-cutting system shown in FIG. 1.

FIGS. 1 to 4 and 10 show a hair-cutting system 1. The hair-cutting system 1 comprises a hair-cutting apparatus 2 for cutting hairs, which apparatus is held in a hand during operation. The hair-cutting apparatus 2 has an elongate housing 3, which basically comprises two housing halves 4 and 5, which adjoin one another along a parting line 6. The housing 3 has an angular shape, as is apparent from FIGS. 3 and 4. The housing 3 comprises a grip part 7, which can be or is held in a hand during operation of the hair-cutting apparatus 2 or the hair-cutting system 1, and a coupling part 8 which projects from the grip part 7 and is inclined relative to the grip part 7. As is apparent in particular from FIGS. 3 and 4, the housing 3 of the hair-cutting apparatus 2 has a front side bearing the reference numeral 10 and a back side bearing the reference numeral 11. As is also apparent from the two FIGS. 3 and 4, the coupling part 8 and the grip part 7 adjoin one another in a convex housing portion 12 at the front and in a concave housing portion 13 at the back.

The hair-cutting apparatus 2 of the hair-cutting system 1 comprises a toothed cutting device 14 in the area of the distal end 9 of the coupling part. The toothed cutting device 14 comprises two toothed cutters 15 and 16 arranged at the location of the front 12 of the hair-cutting apparatus 2. Of the two toothed cutters 15 and 16 the toothed cutter 15 is reciprocatingly drivable by a motor 17 via drive transmission 18. Such measures for driving a reciprocatingly drivable toothed cutter of a toothed cutting device are generally known and are not relevant in the present context, for which reason the drive motor 17 and the drive transmission are only shown as dash-dot lines in FIG. 4.

The hair-cutting system 1 as shown in FIGS. 1 to 4 and 10 further comprises a comb device 19 which can be coupled to the hair-cutting apparatus 2 in the coupling area 9 of the housing 3. The comb device 19 can be mounted onto the hair-cutting apparatus 2 parallel to a mounting direction 20 and, likewise, the comb device 19 is detachable from the hair-cutting apparatus 2 in a direction opposite to the mounting direction 20. The comb device 19, when mounted onto the hair-cutting apparatus 2, comprises a comb section 21 which is stationarily mounted on the hair-cutting apparatus 2 by means of a latching device, not shown, and a comb section 22, which is adjustable relative to the stationarily mounted comb section 21 and, consequently, relative to the hair-cutting apparatus 2 and its toothed cutting device 14, which comb section is adjustable in order to obtain different hair-cutting lengths with a plurality of settings. Since the comb section 22 is adjustable the adjustable comb section 22 is movable relative to the stationarily mounted comb section 21 in a telescopic fashion, for which reason such a comb device 19 is also referred to as a telescopic comb.

The stationarily mounted comb section 21 comprises six strip-shaped juxtaposed comb teeth 23, which each extend parallel to the mounting direction 20. Each comb tooth 23 is integrally connected to a connecting member 25 via an arm 24. The two outer arms 24 are each integrally connected to a reinforcement rib 26 and 27. The stationary comb section 21 further comprises two guide members 28 and 29, of which the first guide member 28 is integrally connected to the reinforcement rib 26 and to the connecting member 25, and the second guide member 29 is integrally connected to the reinforcement rib 27 and to the connecting member 25. The two guide members 28 and 29 of the stationary comb section 21 are integrally connected to one another by an arcuate further connecting member 30. In its central part the further connecting member 30 has a latching projection 31 adapted to cooperate with a latching nose, not shown, provided on the hair-cutting apparatus 2. When the comb device 19 is mounted onto the hair-cutting apparatus 2 the latching projection snaps behind the latching nose, not shown, thus forming a latched connection which stationarily secures the comb section 21 of the comb device 19 to the hair-cutting apparatus 2.

The adjustable comb section 22 also comprises six juxtaposed comb teeth 32, which are planiform—as is apparent particularly from the side views of the comb device 19—and which extend from their tooth tips 33 to their tooth backs 34. Between the tooth tip 33 and the tooth back 34 each comb tooth 32 has a slightly concave contact zone 35. By means of the contact zones 35 the comb teeth 32 can be applied to a skin area of a person, for example a person's scalp.

The comb teeth 32 of the adjustable comb section 22 are interconnected by an arcuate connecting member 36 at the location of the ends of the tooth backs 34. The arcuate connecting member 36 of the adjustable comb section 22 thus extends parallel to the similarly arcuate further connecting member 30 of the stationarily mounted comb section 21, as is apparent particularly from FIGS. 8 to 10. Slightly concave front zones 37 of the comb teeth 32 extend from the tooth tips 33 of the comb teeth 32 towards the hair-cutting apparatus 2, i.e. towards the toothed cutting device 14 thereof. Adjacent the front zones 37 of the comb teeth 32 each comb tooth 32 has a channel 38 which extends parallel to the mounting direction 20. A strip-shaped comb tooth 23 of the stationarily mounted comb section 21, which tooth is oriented in the mounting direction 20, extends in each duct 38. With respect to the adjustable comb section 22 it is to be noted that it comprises two further guide members 39 and 40, of which the first further guide member 39 is visible in FIGS. 8 and 9 and the second further guide member 40 is visible in FIG. 4.

In the hair-cutting system 1 as shown in FIGS. 1 to 4 and 10, when the comb device 19 has been mounted on the hair-cutting apparatus 2, the adjustable comb section 22 is adjustable with respect to the stationarily mounted comb section 21 in a direction parallel to the mounting direction 20. In order to achieve this adjustment of the adjustable comb section 22 with respect to the stationarily mounted comb section 21 parallel to the mounting direction 20, the housing 3 of the hair-cutting apparatus 2 has two diametrically opposed guide grooves 41, which extend parallel to the mounting direction 20 and which are open at the distal end 9 of the coupling part in the area of the toothed cutting device 17, only one guide groove 41 being visible in FIGS. 1, 3, 4 and 10.

As already stated hereinbefore, the stationarily mounted comb section 21 comprises two guide members 28 and 29 and the adjustable comb section 22 comprises two further guide members 39 and 40. With the comb device 19 mounted on the hair-cutting apparatus 2 each of the two guide members 28 and 29 engages stationarily in a guide groove 42. With the comb device 19 mounted on the hair-cutting apparatus 2 each of the two further guide members 39 and 40 of the adjustable comb section 22 engages slidably in a guide groove 41.

Figure 8:
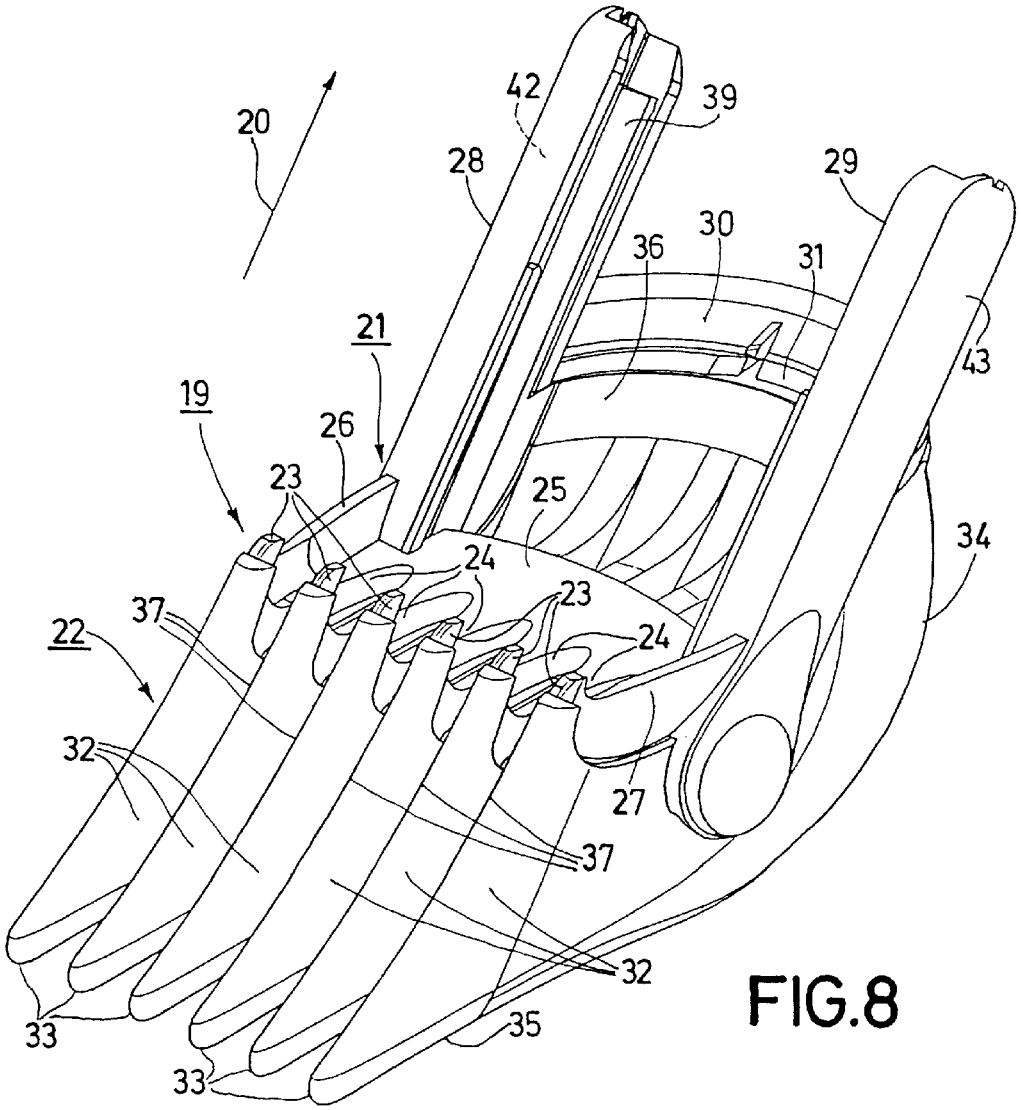
FIG. 8 shows the comb device of the hair-cutting system of FIGS. 1 to 4 in an oblique view from above, the position of the adjustable comb section not being adjusted relative to the stationarily mounted comb section.

As is apparent in particular from FIG. 8, the two guide members 28 and 29 of the stationarily mounted comb section 21 are cross-sectionally U-shaped, their bottom walls 42 and 43 being remote from one another. The two further guide members 39 and 40 of the adjustable comb section 22 are also cross-sectionally U-shaped, their bottom walls being remote from one another. As is apparent from FIG. 8 for the first guide member 28 of the stationarily mounted comb section 21 and the first further guide member 39 of the adjustable comb section 22, each of the U-shaped further guide members 39 and 40 of the adjustable comb section 22 engages in a respective one of the U-shaped guide members 28 and 29 of the stationarily mounted comb section 21.

Figure 9:
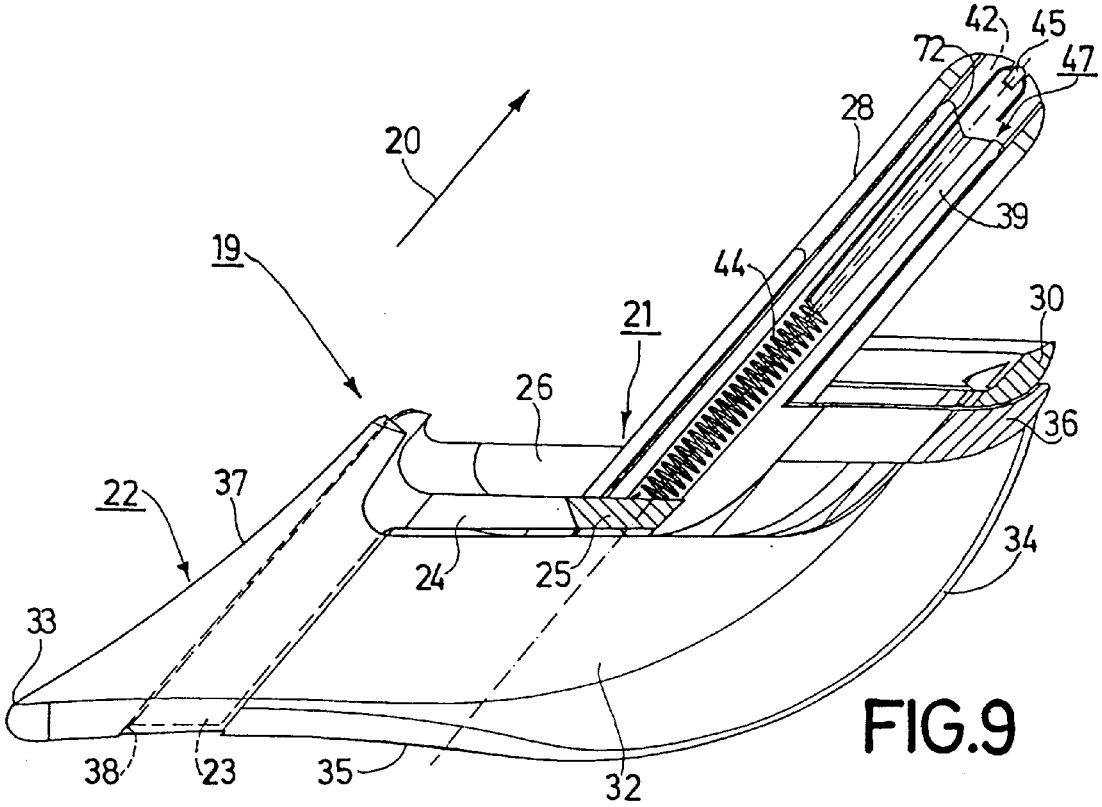
FIG. 9 shows the comb device of FIG. 8 in a side view, partly sectional view, in which the position of the adjustable comb section has not been adjusted relative to the stationarily mounted comb section and which shows the tension spring by means of which the adjustable comb section is held in engagement with the stationarily mounted comb section.

With respect to the comb device 19 it is to be noted that the stationarily mounted comb section 21 and the adjustable comb section 22 are advantageously loaded relative to one another by means of tension spring 44, as is apparent from FIG. 9. The tension spring 44 is arranged between the U-shaped first guide member 28 of the stationarily mounted comb section 21 and the U-shaped first further guide member 39 of the adjustable comb section 22, which cooperates with the first-mentioned guide member. The tension spring 44 has one end coupled to a projection 45 of the first guide member 28 of the stationarily mounted comb section 21. A second end of the tension spring 44 is coupled to a projection, not shown, of the first further guide member 39 of the adjustable comb section 22.

The hair-cutting system 1 comprises positioning means for adjusting and positioning the adjustable comb section 22 in a plurality of operating positions with respect to the stationarily mounted comb section 21. In the present case, these positioning means advantageously comprise an adjustment device 46, shown in FIGS. 4 to 7, which adjustment device has been provided on the hair-cutting apparatus 2 and can be set to a plurality of selectable settings with the hand in which the hair-cutting apparatus 2 is held during operation. Furthermore, coupling means 47 arranged between the adjustment device 46 and the adjustable comb section 22 serve for automatically coupling the adjustment device 46 and the adjustable comb section 22 when the comb device 19 is mounted onto the hair-cutting apparatus 2. When the comb device 19 is mounted onto the hair-cutting apparatus 2 the adjustable comb section 22 is automatically movable into a desired operating position with the aid of the adjustment device 46 via the coupling means 47, which operating position is determined by the selected setting of the adjustment device 46.

The adjustment device 46 includes an adjustment button 48 which can be set to a plurality of selectable settings by the hand in which the hair-cutting apparatus 2 is held during operation, and which is disposed in the area of the front 10 of the hair-cutting apparatus 2, adjacent the coupling part 8, as is apparent from FIGS. 1 to 4. Because of its arrangement in the area of the front 10 of the hair-cutting apparatus 2, adjacent the coupling part 8, the adjustment button 48 can be actuated by the thumb of the hand holding the grip part 7 during operation. The adjustment button 48 has been provided with a pointer 49 which cooperates with a scale graduation, not shown, on the housing 3 of the hair-cutting apparatus 2 to indicate the selected setting. The adjustment device 46 further comprises a component part 50 which is movable by means of the adjustment button 48 of the adjustment device 46. The movable part 50 comprises a curved plate portion 51, which is slidably guided by means of similarly curved guide grooves in the housing 3 of the hair-cutting apparatus 2. An essentially hollow cylindrical cross-sectionally rectangular sleeve portion 52 is integrally connected to the plate portion 51. At its end which is remote from the plate portion 51 the sleeve portion 52 is integrally connected to a bar portion 53. Two resilient arms 54 and 55 project laterally from the sleeve portion 52 at the side which is remote from the plate portion 51, and each have a latching projection, 56 and 57 respectively, at their free ends, which latching portions cooperate with latching teeth, not shown, provided in the housing 3 of the hair-cutting apparatus 2. By means of the two latching projections 56 and 57 and the latching teeth, not shown, the transition from one setting of the adjustment device 46 to an adjacent setting can be signalled in that a mechanical resistance is felt.

Figure 6:
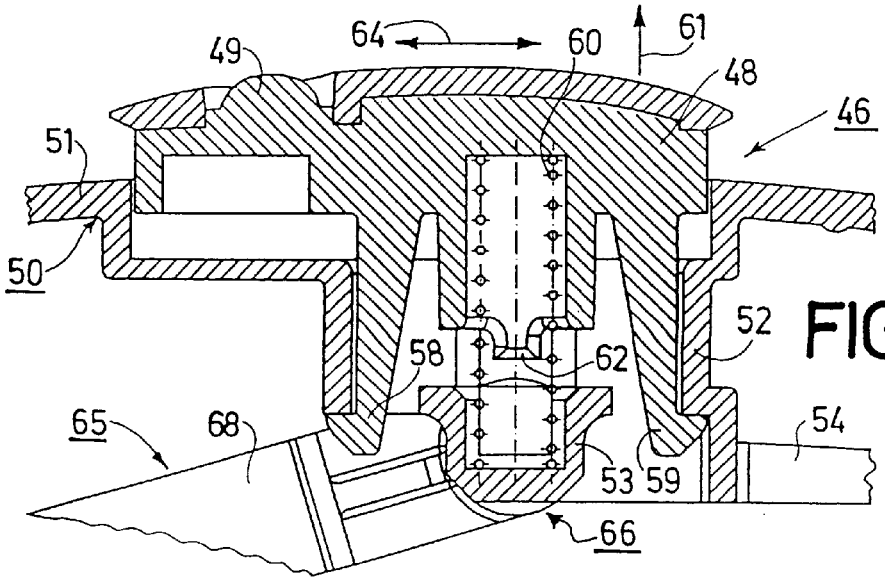
FIG. 6 is a sectional view of a detail of the adjustment device shown in FIG. 5.
Figure 7:
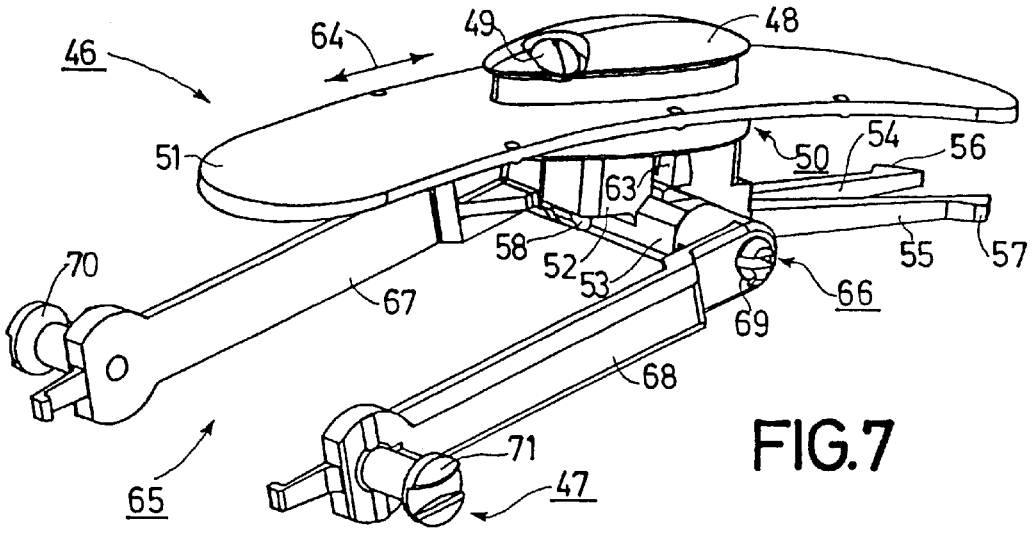
FIG. 7 shows the adjustment device of FIG. 5 in an oblique view from above.

As is apparent particularly from FIG. 6, the adjustment button 48 is coupled to the component part 50 in that two latching arms 58 and 59, which project from the adjustment button 48, engage behind the sleeve portion 52 of the part 50. As is further apparent from FIG. 6, a pressure spring 60 is arranged between the adjustment button 48 and the bar portion 53 of the component part 50, which urges the adjustment button 48 in the direction indicated by an arrow 61 shown in FIG. 6. Two latching projections 62 and 63 project laterally from the adjustment button 48, the latching projection 62 being shown in FIG. 6 and the latching projection 63 in FIG. 7. The two latching projections 62 and 63 traverse openings in the sleeve portion 52 of the component part 50. The two latching projections 62 and 63 are each adapted to cooperate with latching teeth, not shown, provided in the housing 3 of the hair-cutting apparatus 2.

When the adjustment button 48 assumes its rest position, shown in FIGS. 1 to 7, under the influence of the force exerted by the pressure spring 60, the two latching projections 62 and 63 engage with the latching teeth, not shown, as a result of which the adjustment button 48 and, consequently, the adjustment device 48 cannot be moved in a parallel to the direction indicated by the double-headed arrow 64. The adjustment button 48 and, as a consequence, the adjustment device 46 are thus latched in a first setting. Likewise, the adjustment button 48 and, consequently, the adjustment device 46 can be latched in each of their further settings. When the adjustment button 48 is pressed in a direction opposite to that indicated by the arrow 61 against the force of the pressure spring 60, the latching projections 62 and 63 are disengaged from the latching teeth, not shown, as a result of which the adjustment button 48 and, consequently, the adjustment device 46 can be moved, i.e. slid, to a desired setting in a direction parallel to that indicated by the double-headed arrow 64. When the adjustment button 48 is subsequently released the adjustment button 48 resumes its rest position under the influence of the pressure spring 60, upon which the latching projections 62 and 63 again engage with the latching teeth, not shown, thereby latching the adjustment button 48 and the adjustment device 46 in the desired setting.

The adjustment device 46 further comprises transmission means 65, which are connected to the component part 50 and which are operatively connected to the coupling means 47 via the component part 50. In the present hair-cutting system 1 the component part 50, which is movable by means of the adjustment button 48, and the transmission means 65 are connected to one another via a hinge connection 66. In the present case the transmission means 65 comprise two arms 67 and 68, which are each hingeably connected to the bar portion 53 of the component part 50 via a hinge 69, only one hinge 69 being shown in the Figures. Thus, said hinged connection 66 is formed by means of the two hinges 69.

For a better understanding it is to be noted that the coupling means 47 comprise coupling pins 70 and 71, which project into the guide grooves 41 through passages in the housing 3, which are not shown, and coupling stops 72 and 73, which are arranged on the two further guide members 39 and 40 of the adjustable comb section 22. Of the two coupling stops 72 and 73 the coupling stop 72 is visible in FIG. 9 and the coupling stop 73 in FIG. 4.

In the hair-cutting system I as shown in FIGS. 1 to 4 and 10 the hair-cutting apparatus 2 can be used for cutting hairs without the comb device 19, if this is desired by a user of the hair-cutting system 1. However, alternatively the hair-cutting system 1 can be used with the comb device 19 attached to the hair-cutting apparatus 2, hairs being cut in such a manner that by means of the comb device 19 always a desired distance is maintained between the toothed cutting device 14 of the hair-cutting apparatus 2 and the skin surface from which the hairs to be cut project.

To mount the comb device 19 onto the hair-cutting apparatus 2 the comb device 19 is placed onto the hair-cutting apparatus 2 in the mounting direction 20, the guide members 28 and 29 of the comb device 21, which after mounting is stationarily attached to the hair-cutting apparatus 2 by means of the latching nose, not shown, and the latching projection 31, being inserted into the guide grooves 41. During this insertion the coupling pins 70 and 71 can assume the operating position shown in FIG. 4, which is the case when the adjustment button 48 and, consequently, the adjustment device 46 are latched in the afore-mentioned first setting, which corresponds to the shortest hair-cutting length adjustable by means of the comb device 19. When the comb device 19 is mounted onto the hair-cutting apparatus 2 in the operating condition as illustrated in FIG. 4, the coupling stops 72 and 73 on the two further guide members 39 and 40 of the adjustable comb section 22 do not cooperate with the coupling pins 70 and 71 until the end of the mounting operation, as a result of which the adjustable comb section 22 remains substantially in an unchanged position with respect to the stationarily mounted comb section 21, so that the operating condition illustrated in FIGS. 1, 2, 3, 4, 8 and 9 is obtained when the comb device 19 has been mounted completely onto the hair-cutting apparatus 2.

Figure 4:
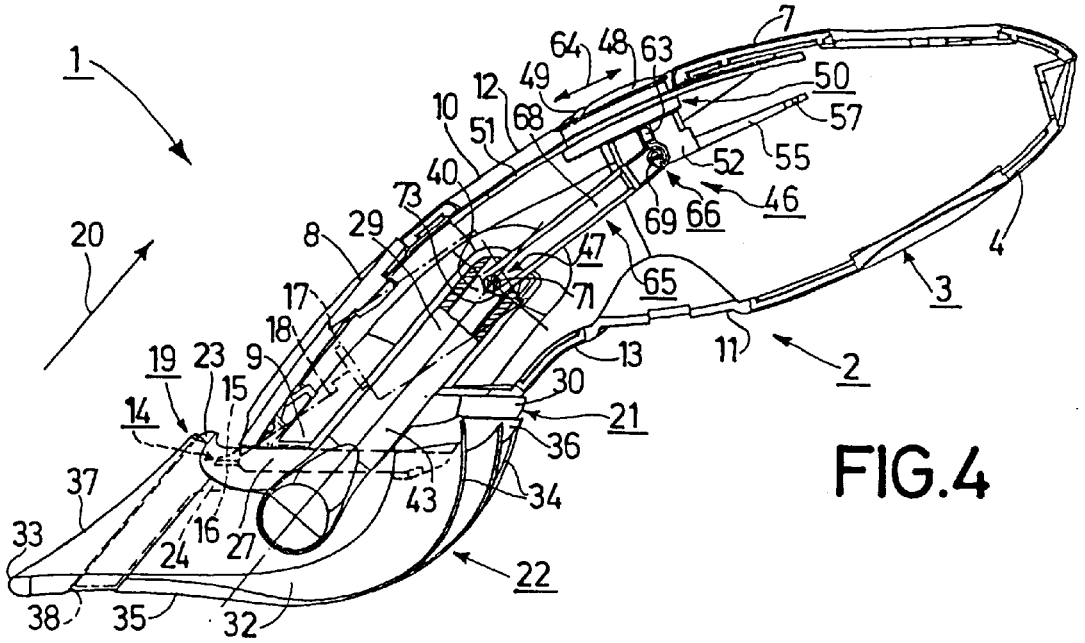
FIG. 4 shows the hair-cutting system of FIGS. 1 to 3 in a view similar to that in FIG. 3 but in which one housing half of the hair-cutting apparatus is not shown, so that an adjustment device is visible by means of which the adjustable comb section of the comb device can be set into a desired operating position.
Figure 5:
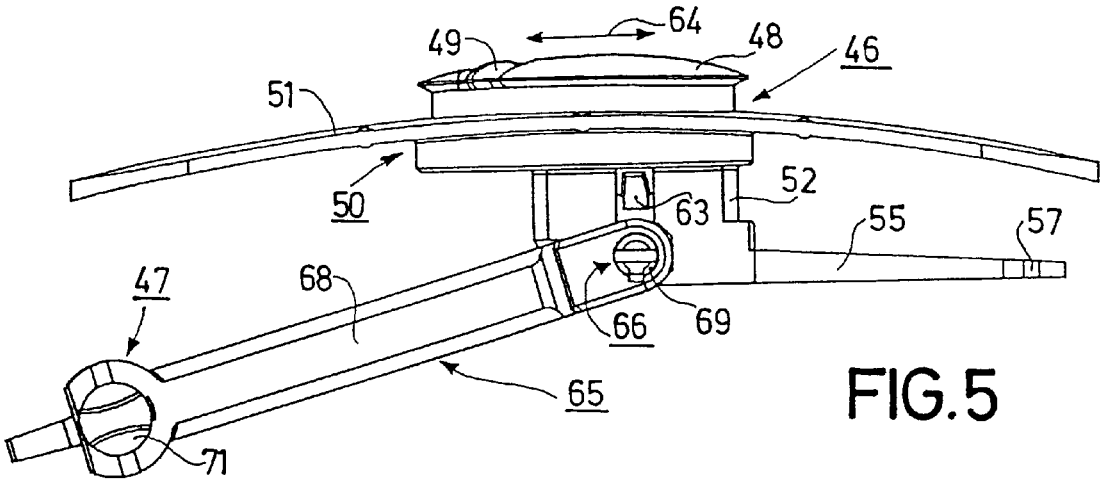
FIG. 5 a is a side view showing the adjustment device of the hair-cutting apparatus of the hair-cutting system of FIGS. 1 to 4 to an enlarged scale in comparison with FIG. 4.

However, if before the comb device 19 is mounted onto the hair-cutting apparatus 2 the adjustment device 46 has been set to another desired setting by means of the adjustment button 48—in which setting the adjustment button 48 and the adjustment device 46 are latched by means of the latching projections 62 and 63, the coupling pins 70 and 71 then assuming an operating condition position shifted with respect to the operating shown in FIG. 4 in a direction opposite to that indicated by the arrow 20. In this operating condition the coupling stops 72 and 73 already abut against the coupling pins 70 and 71 of the coupling means 47 at an earlier instant than in the previously described operating condition, when the comb device 19 is mounted onto the hair-cutting apparatus 2. As a result, the adjustable comb section 22 can no longer be moved any closer to the hair-cutting apparatus 2, but only the comb section 21, which after it has been slid wholly onto the hair-cutting apparatus 2 is latched to the hair-cutting apparatus 2 by means of the latching projection 31 and the latching nose, not shown. In this way it is achieved that, when the comb device 19 is mounted onto the hair cutting apparatus 2, the adjustable comb section 22 is automatically movable into a desired operating position, which is determined by the selected setting of the adjustment device 46, by means of the adjustment device 46 via the coupling means 47, i.e. the coupling pins 70 and 71 and the coupling stops 72 and 73.

Figure 10:
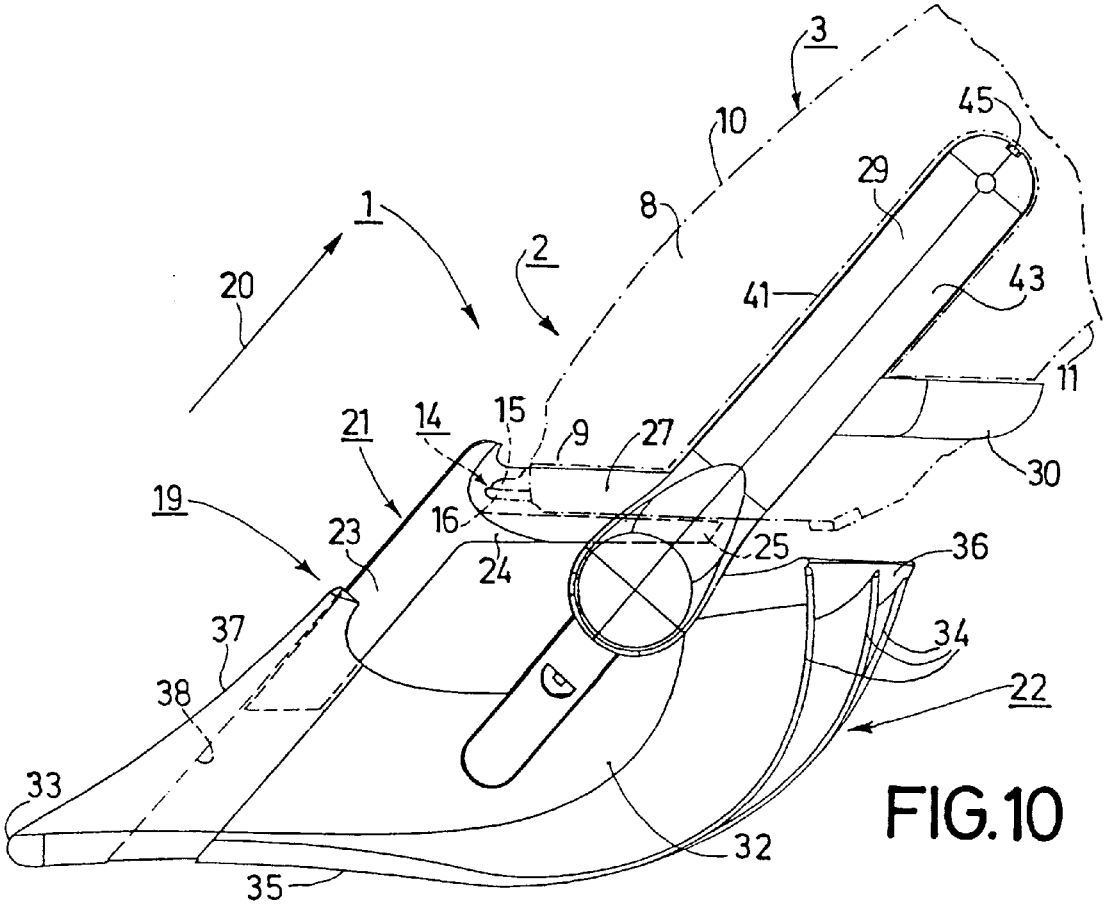
FIG. 10 shows a part of the hair-cutting system of FIGS. 1 to 4, the adjustable comb section of the comb device being held in a desired operating position with respect to the stationarily mounted comb section in opposition to the force of the tension spring.

In this way the adjustable comb section 22 is held in an operating position which is further away from the hair-cutting apparatus 2, so that in this case a greater hair cutting length is set, as is apparent from FIG. 10. Although in this case the adjustable comb section 22 is held in an operating position which is further away from the hair-cutting apparatus 2, it is achieved by means of the strip-shaped comb teeth 23 of the comb section 21, which is stationarily mounted on the hair-cutting apparatus 2, that by means of the strip-shaped comb teeth 23 of the stationarily mounted comb section 21 the comb teeth 32 of the adjustable comb section 22 are extended up to the toothed cutting device 14 of the hair-cutting apparatus 2, so that the hairs guided by the comb teeth 32 and the comb teeth 23 and to be severed by the toothed cutting device 14 are actually guided properly up to the toothed cutting device 14, which is advantageous for a correct guidance of the hairs to be cut and for a reliable cutting by means of the toothed cutting device 14.

Figure 3:
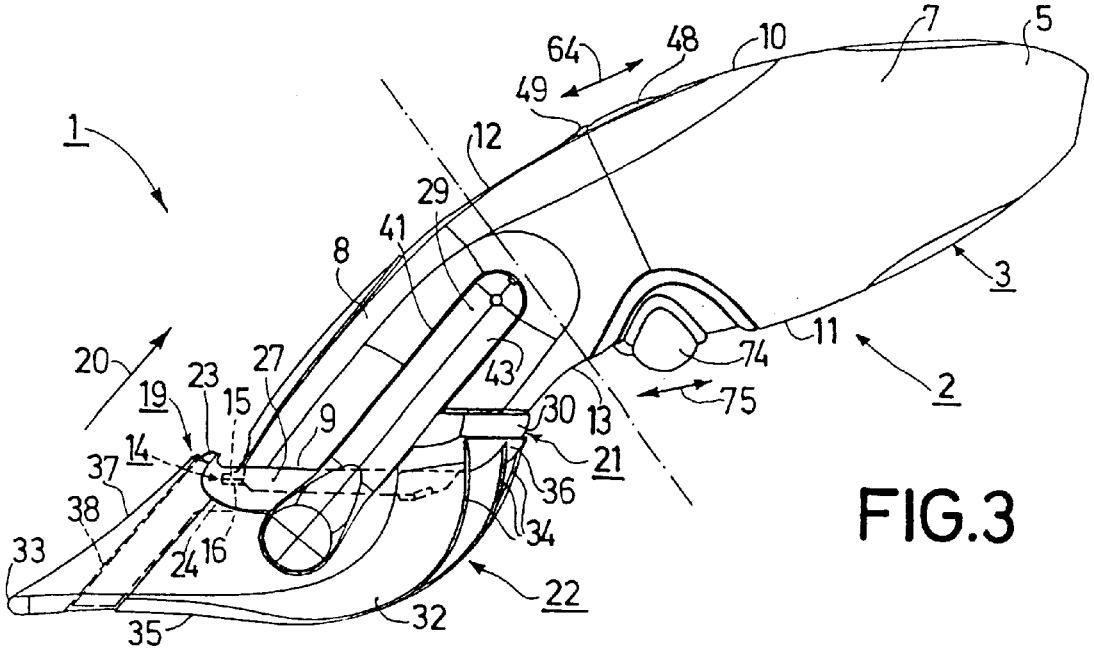
FIG. 3 is a side view of the hair-cutting system shown in FIGS. 1 and 2, the on/off button being visible in FIG. 3.

In the hair-cutting system 1 as shown in FIGS. 1 to 4 and 10 the hair-cutting apparatus 2 further comprises an on/off button 74 in the grip part 7 of the housing 3, as can be seen in FIG. 3. The on/off button 74 is movable between an on-position and an off-position as indicated by a double-headed arrow 75. By means of the on/off button 74 the drive motor 17 of the hair-cutting apparatus 2 can be turned on and turned off.

As is apparent from FIG. 3, the on/off button 74 in the hair-cutting system 1 is disposed in the area of the back 11 of the hair-cutting apparatus 2, adjacent the coupling part 8, and the on/off button 74 is then disposed substantially diametrically opposite to the adjustment button 48. The on/off button 74 is disposed directly adjacent the concave housing part 13. As a result of its arrangement, the on/off button 74 can be actuated advantageously by at least one finger of the hand in which the grip part 7 is held during operation. As already stated, the on/off button 74 is movable between an on-position and an off-position as indicated by a double-headed arrow 75. Thus, the on/off button 74 is formed by a slide button, which in the present case can be actuated by two adjacent fingers of the hand in which the grip part 7 is held during operation.

In the hair-cutting system 1 described above it is achieved in a simple manner and substantially without any additional means that the adjustment button 48 is simply and easily movable between its various settings with the thumb of the hand in which the hair-cutting apparatus 2 is held during operation and, moreover, that the on/off button 74 can be actuated simply and easily with another finger of the hand in which the hair-cutting apparatus 2 is held during operation, in such a manner that for the actuation of the adjustment button 48 and the on/off button 74, respectively, it is not necessary to change the hold on the hair-cutting apparatus 2 during operation. This is because of the ergonomically particularly preffered arrangement of the two buttons 48 and 74. Both the adjustment button 48 and the on/off button 74 are constantly in contact with those fingers of the hand holding the hair-cutting apparatus 2 during operation which are envisaged for the actuation of these buttons 48 and 74. Thus, switching-on and switching-off of the motor 17 as well as the actuation of the adjustable comb section 22 of the comb device 19 can be performed by means of the hand holding the hair-cutting apparatus 2 during operation, without having to change the hold of the hand holding the hair-cutting apparatus 2 during operation. This ensures a very easy and convenient use of the hair-cutting system 1. For a convenient use the angular shape of the housing 3 has also proved to be very advantageous, because as result of this the coupling part 8 and, consequently, the toothed cutting device 14 are in a favorable position for cutting hairs while the grip part 7 is being held in a hand.

The invention is not limited to the embodiment described by way example in the foregoing. For example, an on/off button of a hair-cutting apparatus of a hair-cutting system in accordance with the invention can also be formed by a push-button. Moreover, the housing of a hair-cutting apparatus of a hair-cutting system in accordance with the invention need not necessarily have an angular shape but it may alternatively have a substantially straight shape.

We claim:

1. A hair-cutting apparatus which comprises:

an elongate housing having a grip part to be held in a hand during operation, and a coupling part which is connected to the grip part and which has a distal coupling-part end remote from the grip part, at the location of the distal coupling-part end, a toothed cutting device having two toothed cutters disposed at the location of a front side of the hair-cutting apparatus and drivable by a motor accommodated in the housing, an on/off button, which is arranged in the grip part of the housing and which is movable between an on-position and an off-position to turn the motor on and off, and a comb device which is attachable to and detachable from the housing, at least one comb section of said comb device being adjustable to a setting selected from a plurality of settings with respect to the toothed cutting device to obtain different hair-cutting lengths, the housing comprising an adjustment button, for adjusting at least the comb section with respect to the toothed cutting device during operation of the apparatus, which adjustment button is disposed in the area of the front side of the hair-cutting apparatus, adjacent the coupling part, wherein the on/off button is arranged in the area of a back side of the hair-cutting apparatus, adjacent the coupling part, and is disposed substantially opposite the adjustment button which is on said front side, the on/off button being actuatable by at least one finger of the hand in which the grip part is held during operation and the adjustment button being actuatable by at least the thumb of the hand in which the grip part is held during operation, each said button being actuatable without having to change the position of the hair-cutting apparatus from that in which it is held prior to actuation of said button.

2. A hair-cutting system as claimed in claim 1, wherein the on/off button is formed by a slide button, which can be actuated by two adjacent fingers of the hand in which the grip part is held during operation.

3. A hair-cutting system as claimed in claim 1, wherein the coupling part of the housing of the hair-cutting apparatus is inclined relative to the grip part; the coupling part and the grip part adjoin one another in a convex housing part at the front and in a concave housing part at the back; and the on/off button is arranged directly adjacent the concave housing.

* * * * *